United States Patent [19]

Kristofek

[11] Patent Number: 4,475,147

[45] Date of Patent: Oct. 2, 1984

[54] ADJUSTABLE WALL WASH REFLECTOR ASSEMBLY FOR A RECESS MOUNTED LIGHTING FIXTURE

[75] Inventor: Paul J. Kristofek, Hickory Hills, Ill.

[73] Assignee: McGraw-Edison Company, Rolling Meadows, Ill.

[21] Appl. No.: 409,431

[22] Filed: Aug. 19, 1982

[51] Int. Cl.[3] ..... F21S 1/02

[52] U.S. Cl. ..... 362/148; 362/147; 362/280; 362/297; 362/298; 362/302; 362/303; 362/304; 362/305; 362/319; 362/346; 362/347; 362/361; 362/364; 362/433

[58] Field of Search ..... 362/148, 147, 280, 297, 362/298, 302, 303, 304, 305, 319, 346, 347, 364, 361, 433

[56] References Cited

U.S. PATENT DOCUMENTS 4,338,655 7/1982 Gulliksen et al. ..... 362/346

*Primary Examiner*—Stephen J. Lechert, Jr.

*Attorney, Agent, or Firm*—Charles W. MacKinnon; Jon C. Gealow; Ronald J. LaPorte

[57] ABSTRACT

A "wall wash" assembly for use with a ceiling mounted, recessed lighting fixture comprising a reflector housing having an open end, includes a ring member dimensioned for receipt in the open end of the reflector housing. A concentric ring segment is mounted on the ring member for movement 360° thereabout. An auxiliary reflector is mounted on the ring segment for movement therewith. Positioning of the auxiliary reflector by movement of the ring segment with respect to the ring member provides a desired "wall wash" illumination pattern. An optional baffle member is receivable on the ring member opposite the auxiliary reflector for blocking light emanating from the reflector housing to be excluded in the "wall wash" illumination pattern.

15 Claims, 7 Drawing Figures

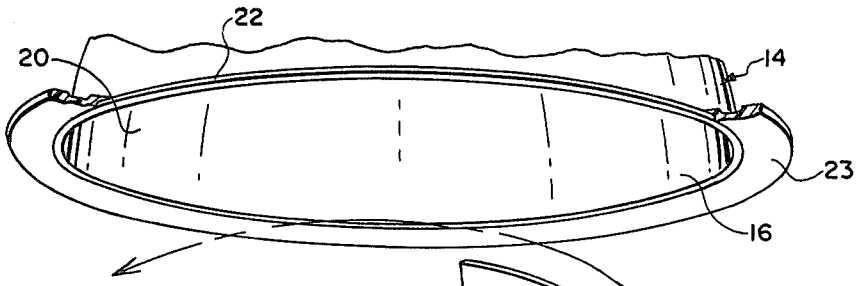
FIG. 4
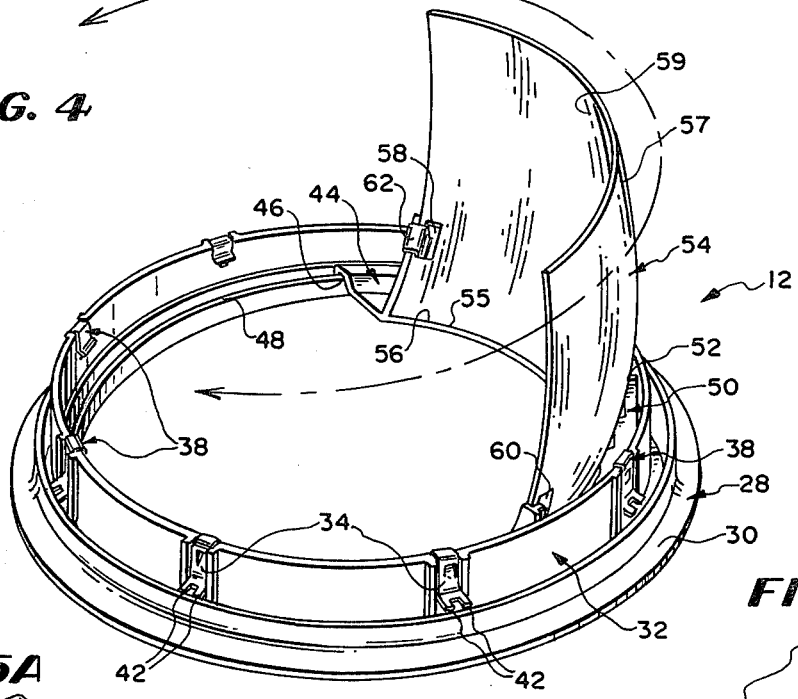
FIG. 5A
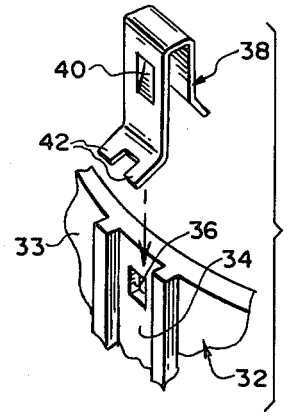
FIG. 5B
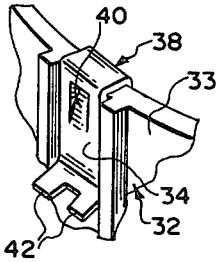
FIG. 6A
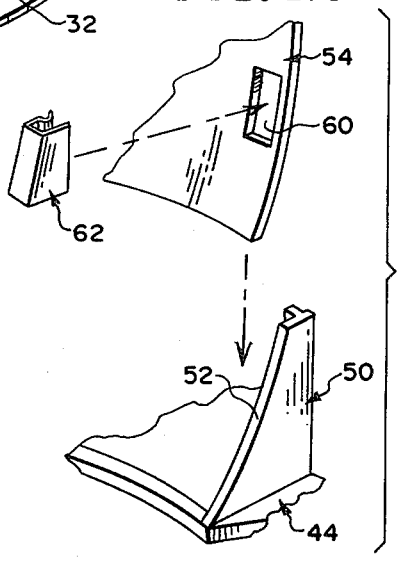
FIG. 7
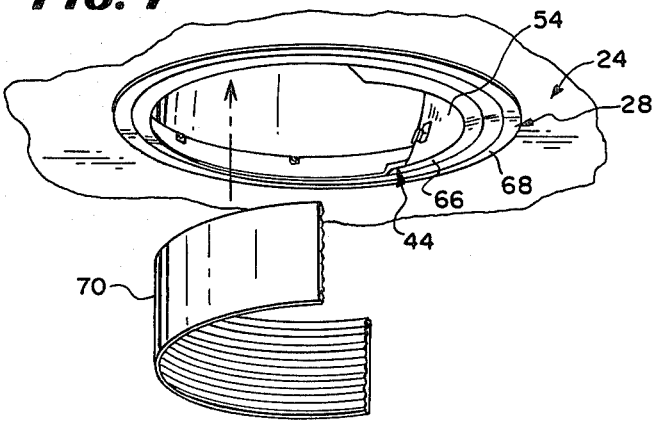
FIG. 6B
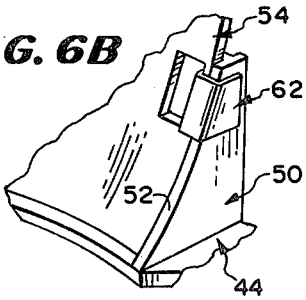

ADJUSTABLE WALL WASH REFLECTOR ASSEMBLY FOR A RECESS MOUNTED LIGHTING FIXTURE

BACKGROUND OF THE INVENTION

This invention relates generally to lighting fixtures designed for recessed mounting in a ceiling surface and more particularly to an assembly for converting a recess mounted lighting fixture into one for adjustably illuminating a wall closely adjacent to the ceiling surface in which the lighting fixture is mounted.

Presently, lighting fixtures are available which are designed to be recess mounted in a ceiling surface a predetermined distance from an adjacent wall for illumination of a predetermined area of the wall. These fixtures are referred to in the lighting industry as "wall wash" fixtures. In many cases, these lighting fixtures are permanently configured to provide a predetermined illumination pattern on the adjacent wall and are not adjustable for varying the area being illuminated. Furthermore, if it ever should be desired to use the fixture for providing only downlight, these prior art fixtures must, in most cases, be removed and replaced with an appropriate recessed fixture.

Other lighting fixtures including arrangements employing baffles and reflectors for directing light from the fixture in various directions, are shown in United States patents. Some examples of these patents are U.S. Pat. Nos. 1,397,803; 1,533,615; 2,113,777; 2,128,470; and 2,665,371.

None of the aforementioned patents describes a fixture which can be recess mounted nor which is suitable both as a "wall wash" fixture and as a conventional, recessed lighting fixture for illuminating an area directly below the ceiling in which the fixture is mounted.

SUMMARY OF THE INVENTION

Accordingly, it is a primary object of the present invention to provide an assembly for use with a recess mounted lighting fixture for converting the lighting fixture into a "wall wash" fixture.

It is still another object of the present invention to provide a conversion assembly of the aforementioned type which is easily installed in an existing recess mounted lighting fixture, which is relatively inexpensive to fabricate and which is efficient in operation.

It is yet another object of the invention to provide a new and improved recess mounted "wall wash" lighting fixture which can be adjusted easily to provide a desired "wall wash" lighting pattern.

Briefly, a preferred embodiment of the "wall wash" assembly for use with a ceiling mounted, recessed lighting fixture, includes an outer ring member dimensioned for receipt in the open end of the reflector housing. Snap-on mounting clips secure the ring in the reflector housing. A concentric, inner ring segment is mounted on the outer ring member for rotation thereabout. The inner ring segment is designed to receive a scoop-shaped reflector, secured thereto by clip members. The inner ring segment is rotatable 360° about the outer ring member for selecting a desired illumination pattern on the wall adjacent to the lighting fixture. The inner ring segment extends slightly below the open end of the recessed reflector housing of the lighting fixture to position the scoop-shaped reflector for more complete illumination of the adjacent wall.

An optional baffle member is receivable on the outer ring member opposite the scoop-shaped reflector for minimizing light reflection from the fixture away from the illuminated wall.

DESCRIPTION OF THE DRAWINGS

In the drawings:

FIG. 4 is an exploded, perspective view of the reflector housing of FIG. 1 and the "wall wash" assembly according to the invention, shown separated therefrom;

FIGS. 5A and 5B are enlarged, fragmentary, perspective views illustrating mounting clips used for removably attaching the "wall wash" assembly according to the invention to the reflector housing of the lighting fixture of FIG. 1;

FIGS. 6A and 6B are enlarged, fragmentary, perspective views of clips used in mounting the "wall wash" auxiliary reflector onto the inner ring segment of the "wall wash" assembly according to the invention; and FIG. 7 is a perspective view of the lighting fixture of FIG. 1, shown receiving an optional light baffle for blocking light reflected from the reflector housing directed outwardly from the fixture away from the wall being illuminated by the auxiliary "wall wash" reflector.

DETAILED DESCRIPTION OF THE DRAWINGS

Figure 1:
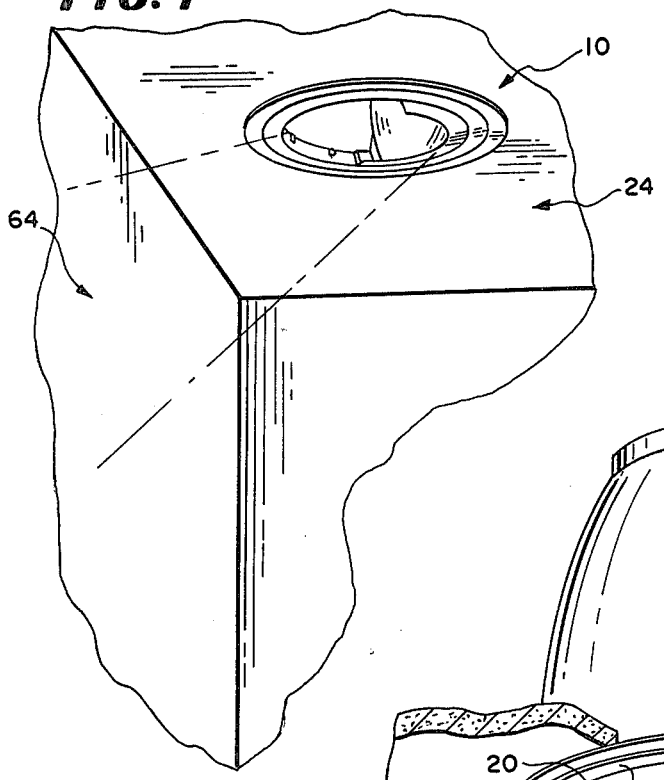
FIG. 1 is a perspective view of a recessed, ceiling mounted lighting fixture including the assembly according to the invention for converting the fixture into a "wall wash" lighting fixture.
Figure 2:
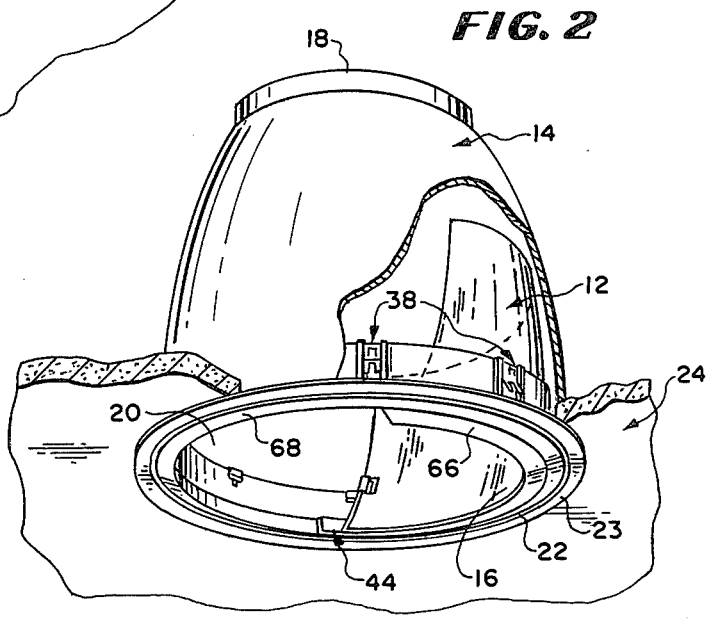
FIG. 2 is an enlarged, partially sectioned, perspective view of the reflector housing of the lighting fixture of FIG. 1 including the "wall wash" assembly according to the invention mounted therein.

Referring now to the drawings in greater detail wherein like numerals have been employed throughout the various views to designate similar components, a lighting fixture 10 including a "wall wash" assembly 12 according to the invention (FIGS. 2–4) for converting the fixture into a "wall wash" lighting fixture, includes a recess mounted reflector housing 14 having a circular shaped open end 16 from which light from a light source (not shown) mounted at the upper end 18 of the reflector housing, emanates. The reflector housing is constructed of aluminum or other suitable material and has a highly reflective interior surface 20. The open end of the reflector housing includes a lip 22 formed thereabout for engagement with a trim ring 23 which is received over the exterior of reflector housing 14 and overlaps the surface 24 of the ceiling surrounding an aperture 26 defined therein, through which the reflector housing is inserted for mounting the lighting fixture therein.

The lighting fixture including reflector housing 14 is of a conventional design. Reflector housing 14 being cylindrical in shape, is employed normally to provide "down light" from the ceiling surface to illuminate an area directly below the ceiling.

The addition of "wall wash" assembly 12 to reflector housing 14 converts the conventional lighting fixture into "wall wash" lighting fixture 10.

Figure 3:
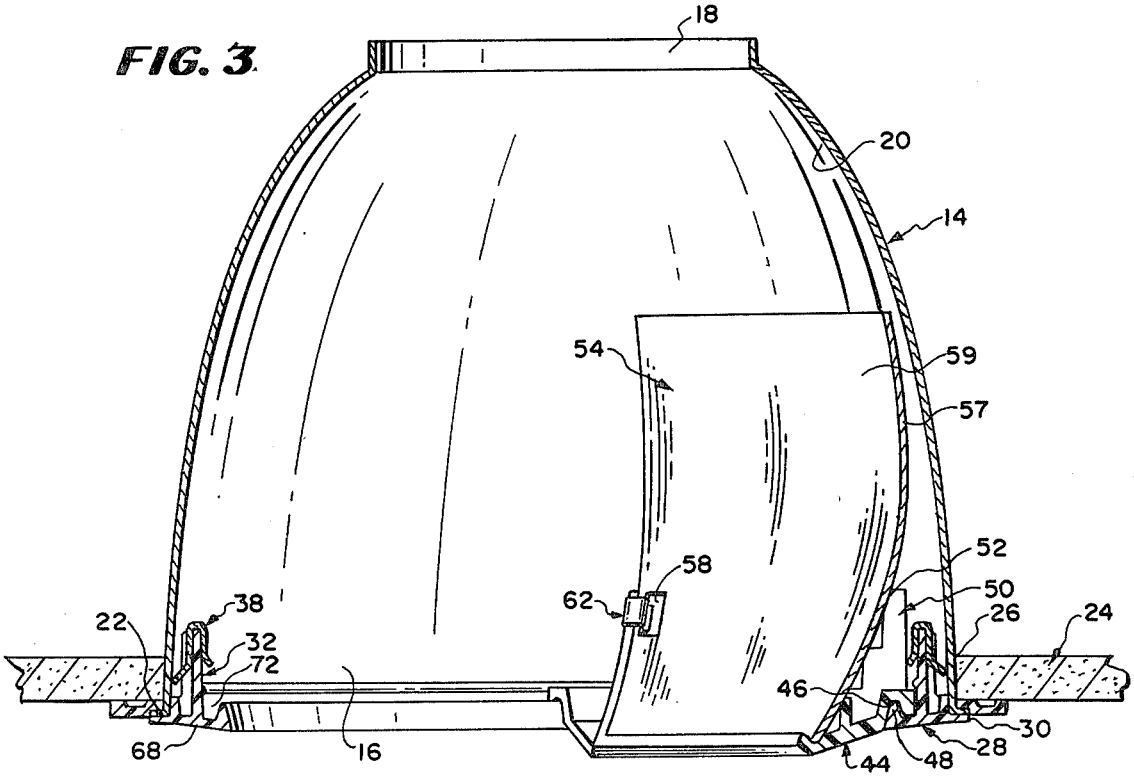
FIG. 3 is an enlarged, side sectional view of the lighting fixture of FIG. 1 including the "wall wash" assembly according to the invention.

"Wall wash" assembly 12 includes an outer ring member 28, best seen in FIGS. 3 and 4. Outer ring member 28 is preferably constructed of molded plastic or other suitable material. Outer ring member 28 includes an outer peripheral lip 30 for engagement with lip 22 of the reflector housing. An upstanding circular wall 32 is formed with lip 30, but is spaced radially inwardly therefrom. Formed about wall 32, at spaced intervals along the outer wall surface 33, are a plurality of recesses 34. Square shaped apertures 36 extending through wall 32, are defined at a predetermined locations within each of the recesses (see FIG. 5A).

Recesses 34 including apertures 36 are provided for receiving U-shaped spring metal clips 38 which serve to removably mount outer ring member 28 within the open, free end 16 of the reflector housing. Clips 38 include a tang 40 which protrudes inwardly toward the interior of the U-shaped clip for receipt in aperture 36 upon sliding the clip onto wall 32 at the location of a recess 34, as shown in FIG. 5A.

A pair of radially outwardly extending feet 42 formed on clips 38 serve to frictionally engage the inner surface 20 of reflector housing 14 upon receipt of outer ring member 28 in open end 16 of the housing. As can be seen in FIG. 4 of the drawings, a plurality of clips 34 are located about the perimeter of wall 32. Upon insertion of outer ring member 28 into the free open end 16 of reflector housing 14, the friction feet pairs 42 of clips 34 engage surface 20 of the reflector housing wall and secure outer ring member 28 in the reflector housing.

Concentrically located within outer ring member 28 is an inner ring segment 44. Inner ring segment is also constructed of molded plastic material. The ring segment is arcuate, having a semi-circular shape. Along the outer edge of inner ring segment 44 is defined a U-shaped groove 46 (see FIGS. 3 and 4). U-shaped groove 46 is dimensioned for snap-on coupling to a rail 48 defined on outer ring member 28, radially inwardly of wall 32 (see FIG. 4).

Inner ring segment 44 when snapped into place on rail 48, is slidable therealong to any position with respect to outer ring member 28, 360° thereabout. Inner ring segment 44 also includes upwardly standing, spaced support ribs 50 each having a curved, radially inwardly facing edge 52. The support ribs are designed for supporting thereagainst a predeterminedly curved, scooped-shaped reflector 54, which as will be described hereinafter, provides a reflective surface 59 to produce the resulting "wall wash" illumination from the lighting fixture. Reflector 54 is formed of aluminum or other suitable material.

The radially inwardly facing edge 55 of the scoop-shaped reflector engages a small inwardly positioned lip 56 formed along inner ring segment 44, for positioning the reflector thereon. Scoop-shaped reflector 54 includes apertures 58, 60, defined at opposite ends thereof, respectively, which are positionable directly adjacent outer support ribs 50 along the inner ring segment.

U-shaped clips 62 are received through apertures 58, 60 and are also received over end support ribs 50 as illustrated in FIGS. 6A, 6B, to retain the reflector in place on the inner ring segment.

It should be noted that the radially inwardly facing edge 55 of reflector 54, is positioned so that it is horizontally lower than the open free end 16 of reflector housing 14, see FIG. 3. In this fashion, light reflected from the scoop-reflector is directed outwardly of the lighting fixture generally horizontally toward a wall 64 adjacent to ceiling surface 24 in which the lighting fixture is mounted.

An arcuate face trim 66 (see FIG. 2) provided on the inner ring segment 44, which is finished in a manner similar to the outer face trim 68 of outer ring member 28, provides an aesthetically pleasing appearance to the lower portion of the lighting fixture.

Briefly, to install the "wall wash" assembly according to the invention in a recess mounted reflector housing 14 of a lighting fixture of the type illustrated, U-shaped clips 38 are snapped onto wall 32 of the outer ring member 28 as shown in FIGS. 5A, 5B of the drawings.

Inner ring segment 44, if not already in place on outer ring member 28, is positioned within the outer ring member with groove 46 of the inner ring segment aligned with rail 48 of the outer ring member. The inner ring segment is then pressed downwardly so that rail 48 is received and removably snapped into position in groove 46, for sliding movement 360° about outer ring member 28 on rail 48.

Next, scoop-shaped reflector 54 is positioned on inner ring segment 44 with leading edge 55 of the reflector engaging lip 56 of the inner ring segment and the rear surface 57 of the reflector engaging the curved front edges 52 of support ribs 50. Thereafter, U-shaped clips 62 are snapped into place through apertures 58, 60 in reflector 54, as shown in FIGS. 6A, 6B, to secure the reflector in position on ring segment 44.

Upon completion of the mounting of the scoop-shaped reflector on inner ring segment 44, the assembly is inserted into open end 16 of reflector housing 14 as illustrated in FIG. 4 of the drawings so that radially outwardly extending friction feet 42 of clips 38 spaced peripherally about the outer ring member 28, engage the inner wall surface 20 of reflector housing 14 and thus retain the assembly in position with respect thereto.

Once the light source (not shown) is illuminated, inner ring segment 44 may be rotated to produce the "wall wash" effect desired.

Referring now to FIG. 7 of the drawings, an optional, semi-circular light baffle 70 is illustrated which is positionable on the outer ring member 28 in the space 72 defined between rail 48 and wall 32, opposite the scoop-shaped reflector. Baffle 70 is provided for blocking light from the fixture which would otherwise be reflected from the light reflective wall 20 of reflector housing 14 opposite reflector 54. In this manner, one viewing the fixture from a vantage point away from the illuminated wall, sees a minimum of light emanating from the fixture. Baffle 70 is constructed preferrably from a flexible plastic material which is bendable into the semi-circular shape shown in FIG. 7, for easy maneuverability and receipt in space 72 of the outer ring member.

As mentioned herefore, light baffle 70 is optional and is not required as a part of the "wall wash" assembly according to the invention.

As can be seen from the aforementioned description, when installed in a conventional, recess mounted lighting fixture having a reflector housing such as 14, the "wall wash" assembly converts the lighting fixture into one which is suitable for illuminating a wall closely adjacent to a ceiling surface in which the fixture is mounted. Because inner ring segment 44 upon which scoop-shaped reflector 54 is mounted, is rotatable about outer ring member 28, the "wall wash" effect can be modified to selectively illuminate various areas of a wall or corner areas of a room as the case may be.

While a particular embodiment of the invention has been shown and described, it should be understood that the invention is not limited thereto since many modifications may be made. It is therefore contemplated to cover by the present application any and all such modifications as fall within the true spirit and scope of the appended claims.

I claim:

1. In a recessed, ceiling mounted lighting fixture including a reflector housing, a source of light mounted in said reflector housing, said reflector housing having a reflective surface for reflecting light from said light source to illuminate an area generally below said lighting fixture, said reflector housing including an open, lower free end having a predetermined shape, an adjustable reflector assembly for selectively altering the illumination pattern of said lighting fixture to provide illumination to the side thereof, said reflector assembly including in combination:

first ring means dimensioned for receipt on the open free end of said reflector housing;

means for removably securing said first ring means on said reflector housing;

second ring means comprising at least a ring segment, dimensioned for receipt on said first ring means concentrically with respect thereto, said second ring segment being mountable on said first ring means for repositioning at various preselected locations therealong; and auxiliary reflector means mounted on said second ring segment for diverting light from said source to the side of said light fixture.

2. A reflector assembly as claimed in claim 1 wherein said means for removably securing said first ring means on said reflector housing includes clip means attachable to said first ring means, said clip means including protrusions for frictionally engaging the reflective surface of said reflector housing, thereby removably securing said first ring means on said reflector housing.

3. A reflector assembly as claimed in claim 1 wherein said auxiliary reflector means includes a scoop-shaped reflector for directing light from said light source generally horizontally and downwardly from said lighting fixture.

4. A reflector assembly as claimed in claim 3 wherein said second ring means extends outwardly of the open end of said reflector housing for positioning a portion of said auxiliary reflector below said lower open end of said reflector housing, said auxiliary reflector portion reflecting light from said source generally horizontally from said lighting fixture.

5. A reflector assembly as claimed in claim 1 wherein said open end of said reflector housing is circular in shape, wherein said first ring means is circular in shape and dimensioned for receipt within said open end of said reflector housing and wherein said second ring means comprises a semi-circular ring segment mounted on said first ring means for movement therealong, whereby said second ring segment is adjustably positionable on said first ring means for directing reflected light from said auxiliary reflector directionally from said reflector housing.

6. A reflector assembly as claimed in claim 5 wherein said first ring means defines a rail therealong and said ring segment defines a groove therealong, said ring segment being slidably mounted on said first ring means by receipt of said rail in said groove.

7. A reflector assembly as claimed in claim 1, further including light baffle means mounted on said outer ring means at a location opposite said auxiliary reflector means for blocking light emanating from said reflector housing in a direction opposite from the light reflected by said auxiliary reflector means.

8. In a recessed, ceiling mounted lighting fixture including a reflector housing, a source of light mounted in said reflector housing, said reflector housing having a reflective surface for reflecting light from said light source to illuminate an area generally below said fixture, said reflector housing being generally cylindrical in shape, having a circular shaped open lower free end, an adjustable reflector assembly for selectively altering the illumination pattern of said lighting fixture to provide illumination of a wall surface closely adjacent the ceiling in which said lighting fixture is mounted, said adjustable reflector assembly including in combination:

a circular ring member, dimensioned for receipt in the open, free end of said reflector housing;

means for removably attaching said ring member on said reflector housing;

a semi-circular ring segment mounted on said outer ring member, concentrically therewith, said ring segment being movable along said ring member 360° thereabout for repositioning said ring segment at predetermined locations therealong; and auxiliary reflector means mounted on said ring segment for movement therewith along said ring member, said auxiliary reflector means being shaped predeterminedly to direct light from said light source toward said wall surface adjacent the ceiling in which said light fixture is mounted.

9. A reflector assembly as claimed in claim 8 wherein said ring segment is mounted radially inwardly of said circular ring member for sliding movement therealong and wherein said ring segment extends outwardly of said reflector housing at the lower, open end thereof, for positioning a portion of said auxiliary reflector means below said open end of said reflector housing, whereby said auxiliary reflector portion reflects light from said source generally parallel to said ceiling toward said adjacent wall surface.

10. A reflector assembly as claimed in claim 8 wherein said auxiliary reflector is predeterminedly curved, wherein said ring segment includes upstanding support ribs having edges curved complementarily to the curvature of said auxiliary reflector means for engagement and support thereof, and further including means for fastening said auxiliary reflector to said ring segment.

11. A reflector assembly as claimed in claim 8 wherein said circular ring member includes an upstanding circular wall and clip means attached to said wall, said clip means including radially outwardly protruding feet, said feet frictionally engaging the reflective surface of said reflector housing for removably mounting said circular ring member on the free end of said reflector housing.

12. A reflector assembly as claimed in claim 11 wherein said circular wall defines a plurality of spaced recesses therealong, each recess defining an aperture extending through said wall, wherein said clip means comprises a plurality of U-shaped clips, each said clip including a tang extending from one leg of the U, each said clip being positionable in overlying relation with said wall at a spaced recess, respectively, said tangs of said clips being received in respective apertures within a corresponding recess for securing said clips to said ring member.

13. A reflector assembly as claimed in claim 8 further including baffle means mountable on said circular ring member opposite said ring segment, for blocking light emanating from said reflector housing in a direction opposite from the light reflected by said auxiliary reflector means.

14. A reflector assembly as claimed in claim 11 wherein said circular ring member includes rail means formed thereabout adjacent said circular wall, wherein said ring segment includes groove means dimensioned for receipt of said rail means for slidably mounting said ring segment on said circular ring member.

15. A reflector assembly as claimed in claim 14 further including baffle means for blocking light emanating from said reflector housing in a predetermined direction, said baffle means being mountable on said ring member between said circular wall and rail means opposite said ring segment.

* * * * *